US005247142A

United States Patent [19]

Yonkovitz et al.

[11] Patent Number: 5,247,142

[45] Date of Patent: Sep. 21, 1993

[54] CIRCUIT INTERRUPTER ARC CHUTE SIDE WALLS COATED WITH HIGH TEMPERATURE REFRACTORY MATERIAL

[75] Inventors: Bernard F. Yonkovitz, Hookstown; Walter W. Panek, Jr., Industry, both of Pa.

[73] Assignee: Westinghouse Electric Corp., Pittsburgh, Pa.

[21] Appl. No.: 887,263

[22] Filed: May 22, 1992

[51] Int. Cl.[5] ..... H01H 9/30; H01H 33/04

[52] U.S. Cl. ..... 200/144 R; 200/144 C

[58] Field of Search ..... 200/144 R-151, 200/144 C, 148 C

[56] References Cited

U.S. PATENT DOCUMENTS

| | | | |
|---|---|---|---|
| 3,735,074 | 5/1973 | Frind et al. | 200/144 C |
| 3,739,115 | 6/1973 | McClain et al. | 200/150 C X |
| 3,801,947 | 4/1974 | Blewitt et al. | 337/246 |
| 4,133,370 | 1/1979 | Bellocci et al. | 164/309 |
| 4,251,699 | 2/1981 | Wiltgen, Jr. | 200/144 C |
| 4,325,345 | 4/1982 | Wilkinson et al. | 123/557 |
| 4,395,606 | 7/1983 | Zaffrann et al. | 200/144 R |
| 4,433,233 | 2/1984 | Hierholzer et al. | 219/553 |
| 4,444,671 | 4/1984 | Wiltgen, Jr. | 200/144 A X |
| 4,516,002 | 5/1985 | Murata et al. | 200/144 C |
| 4,612,426 | 9/1986 | Maier et al. | 200/144 R |
| 4,866,226 | 9/1989 | Hisatsune et al. | 200/147 B |
| 4,879,441 | 11/1989 | Hamm et al. | 200/144 B |
| 4,950,852 | 8/1990 | Goldman et al. | 200/144 C |
| 4,975,551 | 12/1990 | Syvertson | 200/144 C |

*Primary Examiner*—J. R. Scott

*Attorney, Agent, or Firm*—G. R. Jarosik

[57] ABSTRACT

A circuit interrupter includes an arc chute containing high temperature refractory coated side walls. The high temperature refractory material may include a thinner material. The side walls comprise materials such as cotton fiber, wood fiber, phenolic material or fiberglass. The refractory material may be selected from the group of aluminum oxide, sodium silicate or zirconium oxide. The refractory coating is applied to the side walls and allowed to dry, filling gaps between side wall and arc plates, thereby improving the side walls' ability to withstand high temperature arcing, and eliminate voltage loss through the filled gaps.

18 Claims, 1 Drawing Sheet

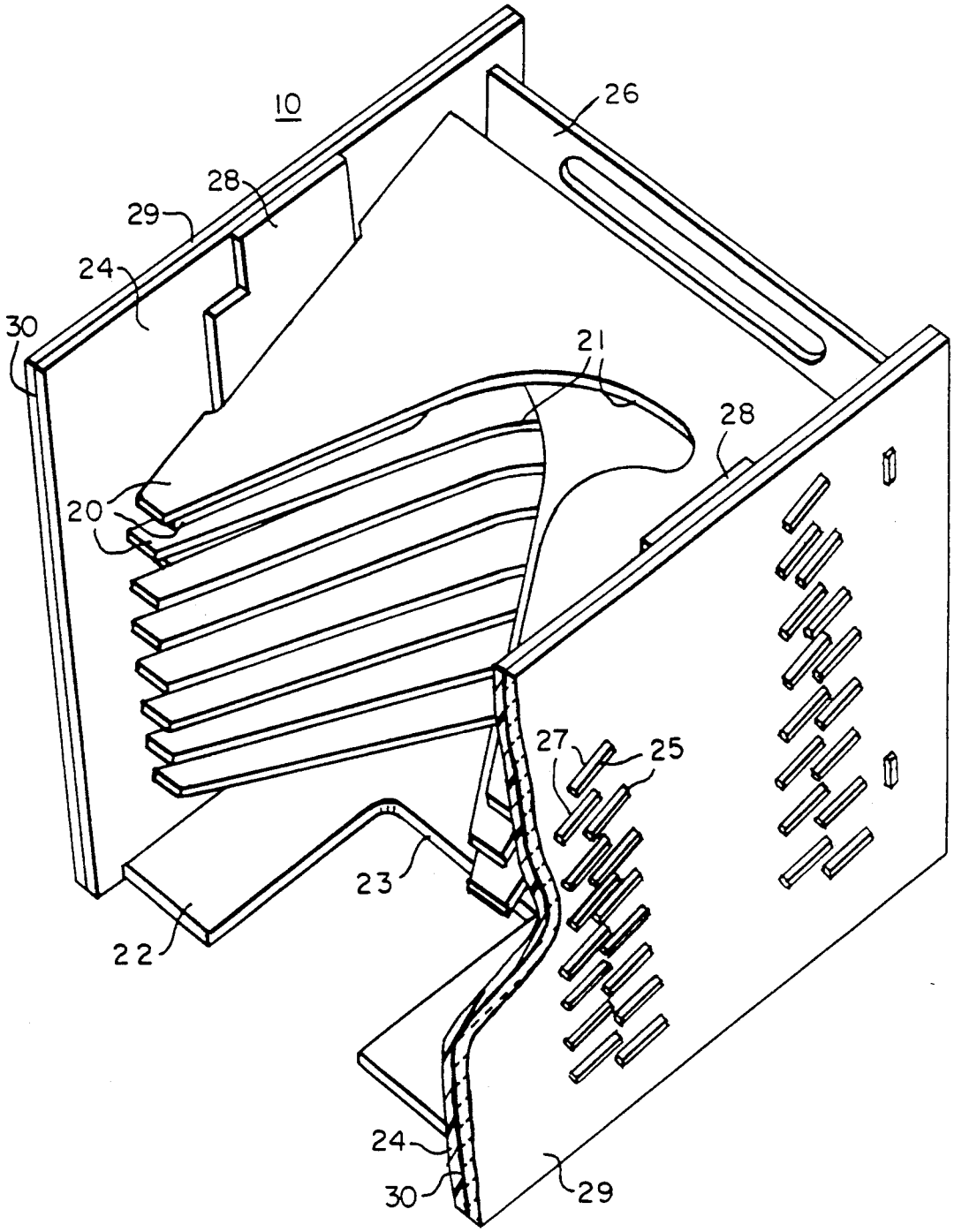
10
26
28
29
24
30
21
28
20
27
25
23
22
24
30
29

CIRCUIT INTERRUPTER ARC CHUTE SIDE WALLS COATED WITH HIGH TEMPERATURE REFRACTORY MATERIAL

BACKGROUND OF THE INVENTION

1. Field of the Invention

The present invention relates to arc quenching for high voltage electrical devices and equipment wherein under certain conditions of operation a high voltage electrical arc is produced that must be quenched to eliminate an undesirable current flow. More particularly, the present invention relates to the use of a high temperature refractory coating on the arc extinguisher side walls of circuit breakers.

2. Description of the Prior Art

In general, circuit breakers having arc extinguishing apparatus for electrical contacts have been widely used to electrically interrupt power when overcurrent flows through power source lines. These circuit breakers typically have arc extinguishing apparatus such as described in U.S Pat. No. 4,866,226, incorporated by reference herein. These arc extinguishers typically comprise a plurality of stacked, substantially U-shaped arc extinguishing plates which surround the fixed and movable contacts of the circuit breaker. When the circuit breaker contacts are opened, creating an arc therebetween, the arc is driven and expanded in the direction of the extinguishing plates through electromagnetic action, causing the arc to divide into sections and be cooled down by the arc extinguishing plates so as to be extinguished.

The arc extinguishing plates are typically surrounded by a non-conducting single or double side wall consisting of fiber, such as cotton, or wood pulp, plastic, such as phenolic materials, or fiberglass. Holes are punched into these side walls to position and support the arc extinguisher plates, thereby creating the necessary spacing between the plates to enhance arc extinguishing capability. The protruding ends of the arc extinguisher plates are typically attached to the side wall by staking or spinning, the side wall and each pair of adjacent arc plates defining a chute for extinguishing the arc segmented by the plates.

Arc extinguisher side walls have in the past been formed of fibers within a melamine resin matrix, as disclosed in U.S. Pat. No. 4,950,852. Such resins are used to provide a continuous source of arc-quenching gaseous molecular compounds evolved by the heat of the arc.

Others have used side walls formed of a composite material of fiber and a net or porous material having more than 35% apparent porosity to make the arc extinguisher side walls light-absorbing. See U.S. Pat. No. 4,516,002.

U.S. Pat. No. 4,975,551 discloses an arc extinguishing composition comprising an arc-interrupting compound, such as melamine, which is disposed along the path of the arc in combination with a binder composition.

U.S. Pat. No. 4,251,699 discloses an arc-quenching composition comprising a dicyandiamide and an elastomeric binder. The composition is placed sufficiently near the arc such that the heat of the arc causes deionizing and extinguishing gas to be emitted from the composition, thereby extinguishing the arc. The same effect is achieved as disclosed in U.S. Pat. No. 4,444,671 with a composition comprising hexamethylenetetramine, either alone or in combination with a binder or impregnated on other material.

Others have sprayed resin coatings onto the side walls or applied high temperature adhesive tape to the side wall.

Despite these attempts, none of the known devices or techniques fully satisfies all the needs of a reliable circuit breaker arc extinguisher, especially at higher voltages, such as 600 volts.

The fiber material used in the side walls frequently experiences arc resistance surface penetration, and thermal breakdown. Many prior art arc extinguisher devices experience voltage tracking up the side walls as a result of carbon buildup on the side walls from the intense heat of the arc. Gaps in the areas where arc plates intersect the side wall provide a path for voltage to escape the arc extinguisher, rendering it less effective. This problem has persisted in the art for about thirty years.

Accordingly, it is an object of the invention to provide a composition for rendering arc extinguisher side walls resistive to thermal shock.

It is another object of the invention to provide a coating for sealing all gaps between arc plates and side walls to prevent voltage from escaping the arc extinguisher.

It is yet another object of the invention to prevent voltage tracking up the arc extinguisher side walls by eliminating carbon buildup on the side walls.

It is another object of the invention to improve the arc resistance surface penetration on fiber materials comprising the side walls.

It is still another object of the invention to prevent thermal breakdown of the side walls.

It is another object of the invention to provide additional mechanical support to the side wall of the arc extinguisher.

These and other objects are achieved by the preferred embodiments of the invention, as will now be discussed.

SUMMARY OF THE INVENTION

The present invention comprises a high temperature refractory composition for coating the side walls of arc extinguishers. As used herein, the term "high-temperature" refers to temperatures in the 1500° to 3000° F. range. The composition includes a refractory material that may be used alone or mixed with a thinner material for assisting in application, for example, the spraying, brushing or dip application of the refractory composition to the side walls.

The refractory coating preferably forms a composite with the fiberous material of the side wall. This allows the refractory coating to improve arc resistance surface penetration of the fiber material, prevents thermal breakdown of the fiber material by acting as a heat absorber, and provides mechanical support to the side wall.

BRIEF DESCRIPTION OF THE DRAWING

A full understanding of the invention can be gained from the following description of the preferred embodiment when read in conjunction with the accompanying drawing in which:

The FIGURE is an isometric view of an arc extinguisher assembly with which the present invention may be used.

DETAILED DESCRIPTION OF THE PREFERRED EMBODIMENTS

FIG. 1 illustrates one type of arc extinguisher or "arc chute" assembly, as disclosed in U.S. Pat. No. 4,612,426, with which the present invention may be advantageously used. Of course, as will now be readily apparent to those skilled in the art. The invention may be practiced on other types of arc chute assemblies as well.

As illustrated in FIG. 1 each of the arc chute assemblies 10 comprises a series of "arc plates" or "chute plates" 20 that are arranged in vertically-stacked spaced-apart relationship, along with a bottom plate 22, between a pair of side walls or panels 24 that are secured to a back panel 26. The arc plates 20 and bottom plate 22 are fabricated from suitable metal (such as sheet steel) that has been provided with a suitable protective coating or plating to prevent rusting. The side walls 24 and back panel 26 are fabricated from suitable electrically non-conductive material (such as glass fiber reinforced polyester) that is rigid and durable. Each of the arc plates 20 may be provided with a curved opening 21 that extends from one end of the plate toward a corner of the arc chute assembly 10. The plate openings 21 may be aligned and so shaped that the skewed ends of the openings in adjacent plates extend toward opposite corners of the chute assembly 10, as shown in FIG. 1. This facilitates interruption of the arc since the chute plates 20 not only divide the arc into small segments but direct the arc segments toward opposite corners of the chute assembly 10. The plate 22 at the bottom of the chute assembly 10 is provided with a rectangular opening 23 that extends inwardly from its leading edge to permit the movable contact and contact arm of the circuit breaker to move downwardly through the passageway provided by the chute openings 21, 23 and engage the stationary contact.

The arc plates 20 are retained in stacked and spaced relationship between the side walls 24 by a series of laterally protruding prongs such as T-shaped tabs 25 that project through a plurality of laterally-extending slot openings 27 in the side walls 24 and may be clamped in seated interlocked engagement therewith by a pair of key members 28 that extend along the inner surfaces of the side walls 24 and are wedged against the notched portions of the chute tabs 25.

The high temperature coating of the present invention comprises a refractory material such as a sodium silicate cement, available as No. 1 Sauerisen Paste from Sauerisen Cements, 160 Gamma Drive, Pittsburgh, Pa. 15238-2920, or a $ZrO_2$ or an $Al_2O_3$ based paste, in a binder. The refractory material is preferably admixed with a Thinner material such as sodium silicate solution, available as No. 15 Thinner, also from Sauerisen Cements. Other suitable refractory pastes include CONTRONICS, 900 Series Ceramic Adhesives, from CONTRONICS, 3379 Shore Parkway, Brooklyn, N.Y. 11235; and AREMCO 500 and 600 Series Ceramic Adhesives, available from AREMCO Products, Inc. P.O Box 429, Ossign, N.Y. 10562

The refractory material and thinner material are preferably admixed in a ratio of about 3:1 to 1.5:1, and most preferably in a ratio of about 2:1, by volume, refractory material to thinner, in order to produce a refractory composition that may be painted, for example by brush or spray, or applied by dip coating to the side walls. The refractory material may also be applied in paste form to the side walls. The coat 29 is preferably applied primarily to the outer surface 30 of the sidewall 24 relative to the arc plates 20, although both the inner and outer surfaces of the side wall may be coated. However, coating only the outer surface of the sidewall is most preferred, as it may be accomplished without disassembling the arc extinguisher assembly, which is required to paint the inner surfaces of the side walls. The outer surface 30 of each side wall is preferably sprayed with the coating after the arc extinguisher has been assembled, to create a continuous coating that fills all of the openings 27. By spraying the outer surface 30, and filling the openings 27, the invention prevents gasses and carbon from seeping out through the openings 27 and creating a carbon build up on the outer surface, or "tracking," which eventually can lead to shorting between the arc plates, and reigniting the plasma.

After application of the composition to the side walls, the coating is allowed to dry, for example, by air curing. Other drying techniques, such as heated drying, could also be used. When dry, the coating produces a hardened bonded composite that preferably completely coats the outer side wall and seals all spacing or gaps between the side wall openings 27, tabs 25 of the arc plates 20, thereby preventing or minimizing the escape of voltage, gasses, and carbon through the extinguisher. The containment of voltage in this way reduces the possibility of reignition of the plasma that surrounds the arc, thereby preventing a dielectrical breakdown between the electrical contacts, which would result in a failure of the circuit breaker to interrupt.

The refractory coating of the invention also eliminates carbon buildup on the side walls, thereby preventing voltage tracking up the side walls. Because the coating is refractory in nature, it acts as a heat absorber, preventing or minimizing thermal breakdown of the fiber material in the side walls.

Preferably, the coating, when dry, bonds with the fibers in the side wall, increasing the mechanical strength of the side wall.

It is important that the composition of the invention have the proper consistency in order to flow through spray nozzles and wet the surface of the side wall evenly, without discontinues. Accordingly, the hereinbefore stated ratio of refractory material to thinner is highly preferred.

The coating of the invention has been successfully used on FB 2 pole low and high rating breakers, when single pole circuit tested at 600 volts and 10,000 amps, with no failure being observed, even after repeated testing. When the coating of the invention is applied to the arc extinguisher side walls such that all gaps between the holes punched in the side walls and the arc plates are filled, and interruption occurs, the recovery voltage goes to zero on the first two half cycles of current. This occurs because the voltage cannot find a path along the arc extinguisher side wall to reignite the plasma gas that in turn would provide a path between the separated electrical contacts for the current traverse.

The present invention has been described above in terms of particular preferred embodiments. These embodiments are merely illustrative of the invention, which is defined more generally by the following claims and their equivalents. While many objects and advantages of the invention have been set forth herein, it is understood that the invention is defined by the scope of the following claims, not by the objects and advantages.

We claim:

1. A circuit interrupter for use in an electrical circuit, comprising:

a molded insulating casing;

a pair of separable electrical contacts mounted within said casing for making and breaking the electrical circuit;

control means responsive to overcurrent conditions for causing said separable electrical contacts to make or break the electrical circuit; and an arc chute mounted in said casing around said separable electrical contacts having a pair of non-conducting side walls and a plurality of chute plates mounted therebetween;

wherein said non-conducting side walls are coated with a high temperature refractory material selected from the group consisting of sodium silicate, $Al_2O_3$, and $ZrO_2$.

2. The circuit interrupter as recited in claim 1, wherein said high temperature refractory material is combined with a thinner material.

3. The circuit interrupter as recited in claim 2, wherein said thinner material comprises sodium silicate solution.

4. The circuit interrupter as recited in claim 3, wherein said side walls are comprised of a material selected from the group consisting of cotton fiber, wood fiber, phenolic material, and fiberglass.

5. The circuit interrupter as recited in claim 2, wherein said refractory material and said thinner material are present in a volume ratio ranging between 3:1 to 1.5:1.

6. The circuit interrupter as recited in claim 5, wherein said thinner material comprises sodium silicate solution.

7. An arc extinguishing chute for use in a circuit interrupting device, comprising:

a pair of non-conducting side walls; and a plurality of chute plates mounted between said side walls;

wherein said side walls are coated with a high temperature refractory material selected from the group consisting of sodium silicate, $Al_2O_3$, and $ZrO_2$.

8. The arc extinguishing chute as recited in claim 7, wherein said high temperature refractory material is combined with a thinner material.

9. The arc extinguishing chute as recited in claim 8, wherein said thinner material comprises sodium silicate solution.

10. The arc extinguishing chute as recited in claim 9, wherein said side walls are comprised of a material selected from the group consisting of cotton fiber, wood fiber, phenolic material, and fiberglass.

11. The arc extinguishing chute as recited in claim 8, wherein said refractory material and said thinner material are present in a volume ratio ranging between 3:1 to 1.5:1.

12. The arc extinguishing chute as recited in claim 11, wherein said thinner material comprises sodium silicate solution.

13. A method of coating the side walls of an arc extinguishing chute, comprising:

preparing a coating of high temperature refractory material from the group consisting of sodium silicate, $Al_2O_3$, and $ZrO_2$, and applying said coating to the exterior surfaces of said side walls.

14. The method as recited in claim 13, wherein said coating is prepared as a paste and wherein said application of said coating is by brushing said coating on said side walls.

15. The method as recited in claim 13, further comprising the step of mixing said coating with a thinner material and wherein said application of said coating and thinner material mixture is by spraying said coating on said side walls.

16. The method as recited in claim 15, wherein said thinner material comprises sodium silicate solution.

17. The method as recited in claim 16, wherein said coating and thinner material are mixed in a volume ratio between 3:1 and 1.5:1.

18. The method as recited in claim 13, wherein said coating is prepared as a paste and wherein said application of said coating is by dipping said side walls in said coating.

* * * * *